US006354300B1

(12) United States Patent
Schlisio

(10) Patent No.: US 6,354,300 B1
(45) Date of Patent: Mar. 12, 2002

(54) PUSHER/CUTTER DRUM ARRANGEMENT FOR POSITIONING AND CUTTING ROD-SHAPED OBJECTS

(75) Inventor: Siegfried Schlisio, Geesthacht (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/466,770

(22) Filed: Dec. 20, 1999

(30) Foreign Application Priority Data

Dec. 18, 1998 (DE) ..... 198 58 600

(51) Int. Cl.[7] ..... A24C 1/18

(52) U.S. Cl. ..... 131/83.1; 131/84.1; 131/84.4; 131/46; 131/94; 83/155.1; 83/122; 83/193; 83/100

(58) Field of Search ..... 131/83.1, 84.4, 131/84.1, 46, 94; 83/155.1, 122, 931, 100

(56) References Cited

U.S. PATENT DOCUMENTS 5,402,802 A * 4/1995 Kakiuchi et al. ..... 131/94

* cited by examiner

*Primary Examiner*—Stanley S. Silverman
*Assistant Examiner*—M. Halpern
(74) *Attorney, Agent, or Firm*—Venable; George H. Spencer; Robert Kinberg

(57) ABSTRACT

A pusher/cutter drum arrangement for use in the tobacco-processing industry for longitudinal-axial positioning and cutting of rod-shaped objects includes a rotating trough drum containing receiving troughs for receiving, respectively, the rod-shaped objects in a staggered formation. Alignment contacts extend in the receiving troughs and are adapted for aligning the rod-shaped objects with one another in a transverse direction. A rotating cutting means extends through the receiving troughs for making a transverse cut of the aligned rod-shaped objects.

7 Claims, 3 Drawing Sheets

Fig. 2a
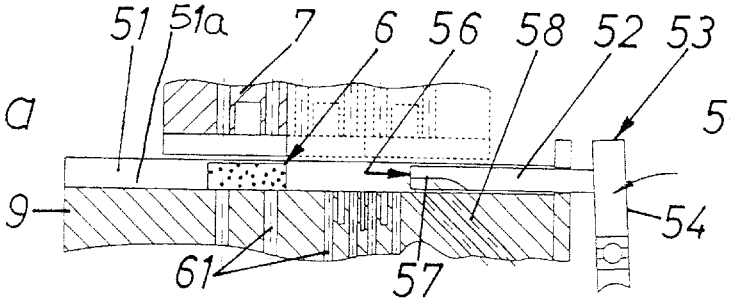
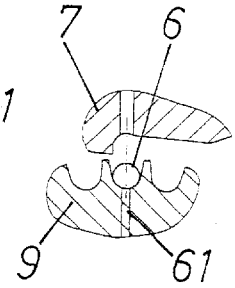
Fig. 2e
Fig. 2b
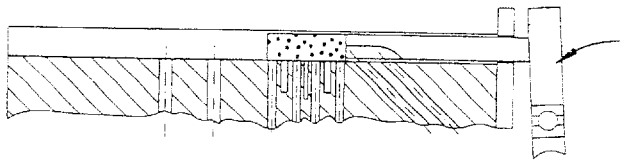
Fig. 2c
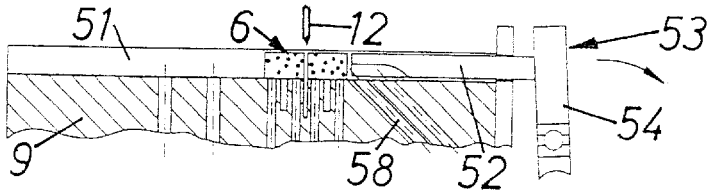
Fig. 2d
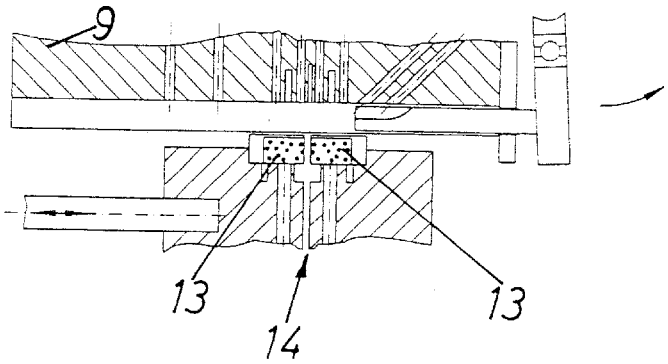
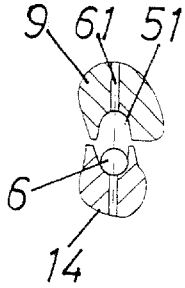
Fig. 2f

PUSHER/CUTTER DRUM ARRANGEMENT FOR POSITIONING AND CUTTING ROD-SHAPED OBJECTS

CROSS-REFERENCE TO RELATED APPLICATIONS

Priority is claimed with respect to German Application No. 198 58 600.0 filed in Germany on Dec. 18, 1998, the disclosure of which is incorporated herein by reference.

The subject matter of U.S. application Ser. No. 09/457, 863 filed Dec. 10, 1999 is related to the disclosure of this application and is incorporated herein by reference.

FIELD OF THE INVENTION

The invention relates to a device used in the tobacco-processing industry for the longitudinal-axial positioning of rod-shaped objects in receiving troughs of a rotating trough drum.

BACKGROUND OF THE INVENTION

Devices of the type mentioned at the outset are customarily employed within the course of finishing filter cigarettes, wherein filter rod components of various standard lengths are prepared for being combined with tobacco rod components in a so-called transverse process, i.e. by being divided, staggered and lined up behind each other, all of which takes place on a conveying path constituted by a plurality of drums. In the course of this processing and handling procedure, a defined longitudinal-axial positioning, or respectively the mutual alignment of the filter rod components in their receiving troughs, which in particular is required for a cutting of filter rod components following each other, is of importance for the number of troughs defining the length of the conveying path.

OBJECT AND SUMMARY OF THE INVENTION

It is an object of the invention to achieve the work steps required for the correct preparation of the filter rod components with a reduced outlay of conveying drums.

The above and other objects are accomplished in accordance with the invention by the provision of a pusher/cutter drum arrangement for use in the tobacco-processing industry for longitudinal-axial positioning and cutting of rod-shaped objects, comprising: a rotating trough drum containing receiving troughs for receiving, respectively, the rod-shaped objects in a staggered formation; alignment contacts extending in the receiving troughs and arranged for aligning the rod-shaped objects with one another in a transverse direction; and a rotating cutting means extending through the receiving troughs for making a transverse cut of the aligned rod-shaped objects.

Accordingly, in accordance with the invention, the trough drum for receiving the rod-shaped objects is embodied as a combined pusher/cutter drum, which has alignment contacts extending in the receiving troughs, as well as associated rotating cutting means.

Such a pusher/cutter drum is preferably used in connection with filter rod components, which have already been previously taken from stock at various standard lengths and divided. For further cutting of these divided filter rod components, it is necessary to again put them into a transverse-axial line formation. For this purpose, the pusher/cutter drum is preferably designed for putting the objects into a transverse-axial cutting formation by means of the longitudinal-axial displacement of the objects which follow each other in a staggered manner.

To achieve such a cutting alignment rapidly and over the shortest possible conveying path, it is provided according to a further feature of the invention that the alignment contacts acting on one front end of the objects can be longitudinally displaced in relation to the receiving troughs. In this way the filter rod components, which previously rested at one side against the respective alignment contacts, are allowed to yield during a cutting operation.

In order to exactly match the sequential alignment and yielding movements of the alignment means, the alignment contacts are equipped with actuating drive means, which move the alignment contacts forward into a defined contact position outside of the effective range of the cutting means, which may comprise circular cutters, whereas in the effective range of the cutting means the actuating drive means pulls the alignment contacts back out of the contact position.

The actuating drive means preferably comprise wobble plates, which rotate at the front face with the trough drum.

For assuring a defined longitudinal-axial and transverse-axial alignment of the objects, or respectively the row of objects, by simple means, it is furthermore provided that in the area of their contact surface, the alignment contacts are provided with a recess so as to form a roof area over the trough bottom of the receiving troughs, and the trough drum includes suction conduits which terminate in the roofed area and which operate together with the alignment contacts.

An assured aspirating effect is provided in accordance with an additional feature of the invention in that the suction conduits can be activated in an alignment zone, which is defined by a circumferential cover of the trough drum.

In order to make possible, or respectively to allow the selection, of a respective positioning of the objects in accordance with the requirements, in particular in connection with the cooperation of the pusher/cutter drum with subsequent drums, it is furthermore provided that the actuating drive means of the alignment contacts dipping into the receiving trough are arranged on at least one front face of the trough drum, or are alternatively arranged on both front faces of the trough drum.

The advantage achieved by the invention resides in the fact that two work steps, which normally would be in conflict with each other, can be performed on a single conveying drum, so that two follow-up drums can be omitted. As a result, the size, or respectively the structural height, of the machine unit, which as a whole is determined by the vertical and horizontal shaft distances between the conveying drums, is reduced.

The invention will be explained in what follows by means of exemplary embodiments in the drawings.

BRIEF DESCRIPTION OF THE DRAWINGS

FIGS. 2*a* to 2*d* are radial sections of the pusher/cutter drum showing various work positions of the pusher/cutter drum in relation to the associated cutting and alignment means.

FIGS. 2*e* and 2*f* are partial front face cross sections at the input and output sides of the drum, respectively.

DETAILED DESCRIPTION OF THE PREFERRED EMBODIMENTS

Figure 1:
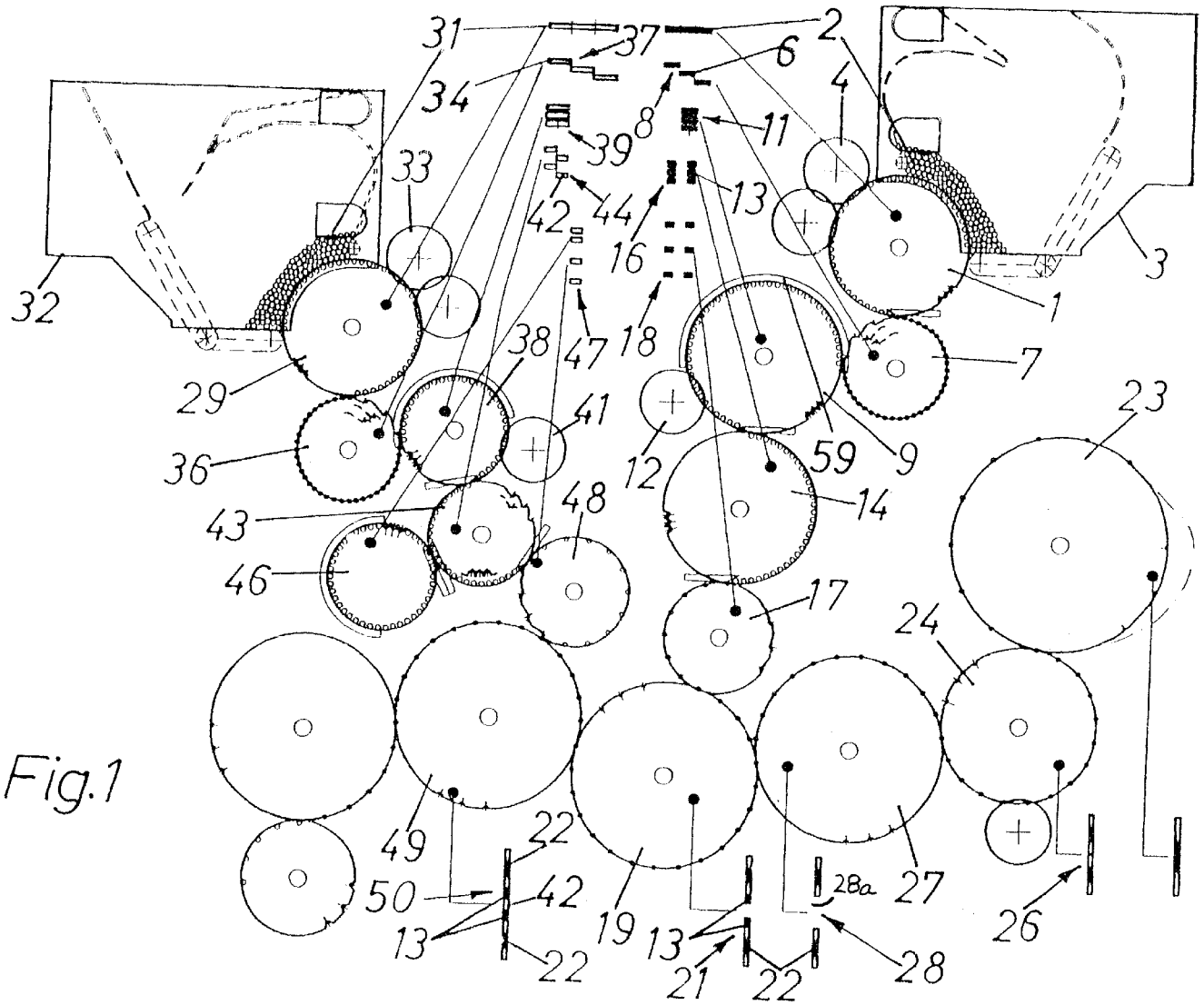
FIG. 1 is a schematic drum plan with associated work steps for uniting two filter rod components with tobacco rod components.

Referring to FIG. 1, there is shown a drum arrangement for a production machine for filter cigarettes in which filter rods 2 of a first component (for example made of charcoal) which are, for example, six times the standard (final) length of the filter plug, are taken from a magazine 3 by means of a cutting drum 1 and are divided into three filter rods 6 of twice the standard length by means of two circular cutters 4. The filter rods 6 are transferred to a staggering drum 7 and are changed by the latter into a staggered formation 8. From the staggering drum 7, the staggered filter rods 6 reach a pusher/cutter drum 9 on which they are changed into a line formation 11 and are divided again into standard length filter plugs 13 by a circular cutter 12.

The filter plugs 13 are placed into a spread formation 16 by means of a spreader drum 14, wherein a greater front end distance is provided between two filter plugs 13 of a pair, and thereafter they are transferred in this formation to an acceleration drum 17, on which the filter plugs 13 are brought into a transversely-axially increased spaced formation 18.

The longitudinally-axially and transversely-axially spaced-apart filter plugs 13 are inserted by an acceleration drum 17 in accordance with the insertion position 21 on an assembly drum 19 directly into a gap 28*a* between two tobacco rods 22. Tobacco rods 22 are supplied in twice the standard length from a drum 23, are cut in the center on a cutter drum 24 in accordance with the cut position 26, are longitudinally-axially pulled apart in accordance with the spread position 28 on a spreader drum 27 and supplied to assembly drum 19 in the spread position.

Filter rods 31 of a second component of, for example, twelve times standard length are taken from a magazine 32 by a cutter drum 29, are divided into three filter plugs 34 of four times the standard length by two circular cutters 33, are transferred to a staggering drum 36 and changed into a staggered formation 37 on the latter. From the staggering drum 36, the staggered filter rods 34 reach a pusher/cutter drum 38, on which they are changed into a line formation 39 and are again divided into filter rods 42 of twice the standard (i.e. final filter plug length) size by a circular cutter 41. The cut filter plugs 42 are again brought into a staggered formation 44 on a staggering drum 43 and, on a pusher drum 46, are placed into a line formation 47, in which they are returned to the staggering drum 43. The transversely-axially spaced-apart filter rods 42 are inserted in accordance with the insertion position 50 into the center in the gap between the two filter plugs 13 on an assembly drum 49 by means of an acceleration drum 48.

The tobacco-filter combination 13, 22, 42 of twice the standard length created in the insertion position 50 is thereafter finished into individual filter cigarettes in a known manner by a cut through the center of the filter rod 42 of twice the standard length to achieve the final filter plug length of filter plugs cut from the original filter rods 31.

The structure and function of the pusher/cutter drums 9 and 38 in accordance with the invention, which are identical to a large degree, will be explained in greater detail in what follows by way of referring to pusher/cutter drum 9, represented, or respectively altered, in FIGS. 2 to 4.

Figure 3:
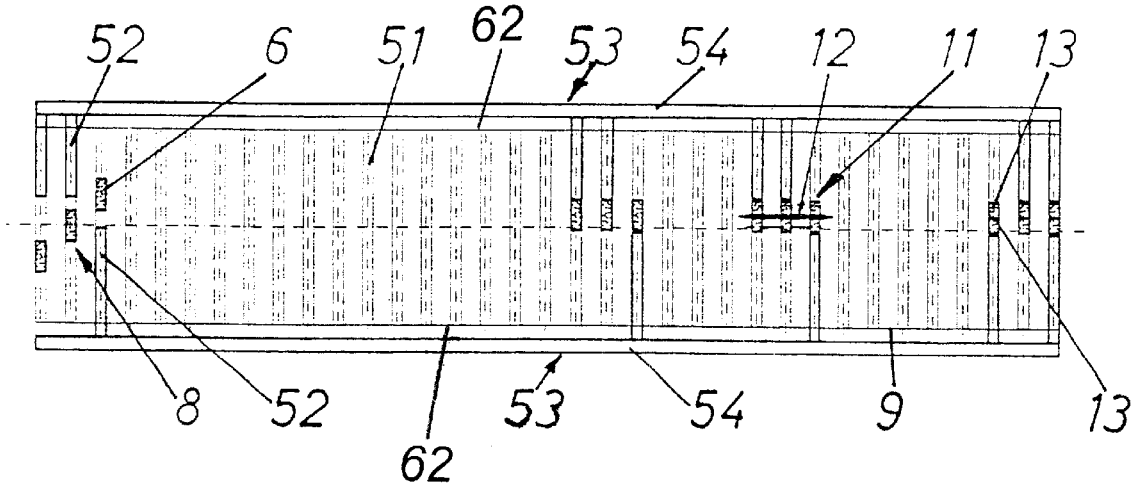
FIGS. 3 and 4 are developed views of the circumference of a conveying drum with alternative arrangements of the alignment means.
Figure 4:
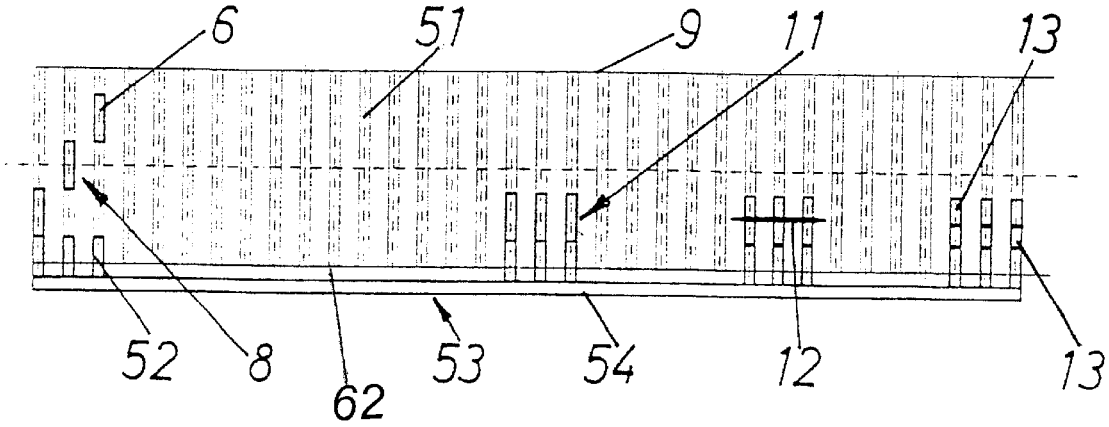

As shown in FIGS. 2 to 4, rod-shaped alignment contacts 52 extend, either from both sides of drum 9 in accordance with FIG. 3, or from one side of the drum in accordance with FIG. 4, in receiving troughs 51 of pusher/cutter drum 9, which cooperates on the input side with staggering drum 7.

During rotation of drum 9, the alignment contacts 52 are guided, longitudinally movable, in the receiving troughs 51 by an actuating drive device 53 in the form of, for example, a wobble disk 54, which rotates around an inclined axis synchronously with pusher/cutter drum 9.

The alignment rods 52 have a recess 57 in the area of their front face contact surface 56, forming a roofed over area covering an area of the trough bottom 51*a* of receiving trough 51 and in which covered area suction conduits 58 terminate. Suction conduits 58 are activated in an activation area of the pusher/cutter drum 9 which is defined by a circumferential cover 59 as shown in FIG. 1.

At the input side of pusher/cutter drum 9 (see FIG. 2*e*), a suction applied to air bores 61 in the bottom of the troughs 51 in pusher/cutter drum 9 facilitates transfer of the filter rods 6 from the staggering drum 7 to pusher/cutter drum 9. On the outlet side (see FIG. 2*f*), the pusher/cutter drum 9 cooperates with spreader drum 14 for transferring the cut filter plugs thereto.

The function of the pusher/cutter drum 9 in relation to the alignment contacts 52 is as follows:

The filter rods are transferred from staggering drum 7 in accordance with FIGS. 2*a* and 2*e* in the staggered formation 8, as shown in FIGS. 3 and 4, to the pusher/cutter drum 9. In the area of the circumferential cover 59, the filter rods are drawn by the activated suction conduits 58 against the alignment contacts 52, which have been moved in accordance with FIG. 2*b* into their maximum insertion position inside the receiving trough 51. In this process, the filter rods are displaced longitudinally-axially into the line formation 11 in accordance with FIGS. 1, 3 and 4.

When passing the circular cutter 12, the wobble disk 54 retracts the respective alignment contacts 52 in accordance with FIG. 2*c* by a slight amount in the respective receiving troughs 51, so that, when the circular cutter 12 enters into the filter rods 6, their cut off filter plugs 13 can yield longitudinally-axially, thus preventing the filter plugs from being squeezed and/or deformed.

As a function of a different length or desired position, or respectively alignment, of the filter plugs 13 on the pusher/cutter drum 9, actuating drive member 53 can be provided in accordance with FIG. 3 at both faces 62 of the pusher/cutter drum 9 or, in accordance with FIG. 4, at one face 62 of the pusher/cutter drum 9.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A pusher/cutter drum arrangement for use in the tobacco-processing industry for longitudinal-axial positioning and cutting of rod-shaped objects, each of the rod-shaped objects having at least one face, the arrangement comprising:

a rotating trough drum containing receiving troughs for receiving the rod-shaped objects in a staggered formation, wherein the rod-shaped objects are received in the receiving troughs, the rod-shaped objects following one another in a staggered manner;

alignment contacts extending in the receiving troughs and adapted for aligning the rod-shaped objects with one another in a transverse direction, wherein the alignment contacts act on the front faces of the rod-shaped objects and are longitudinally displaceable in relation to the receiving troughs;

means for displacing the rod-shaped objects in a longitudinal-axial direction of the rod-shaped objects so that the rod-shaped objects are displaced against the alignment contacts into a transverse-axial row cutting formation;

a rotating cutting means extending through the receiving troughs for making a transverse cut of the aligned rod-shaped objects; and actuating drive means operatively arranged with the alignment contacts for moving the alignment contacts into a defined contact position outside of an effective range of the cutting means, and for retracting the alignment contacts from the contact position.

2. The arrangement in accordance with claim 1, wherein the trough drum has at least one face, and wherein the actuating drive means with correspondingly actuated alignment contacts are arranged at one face of the trough drum.

3. The arrangement in accordance with claim 2 wherein the actuating drive means comprises a wobble disk which rotates with the trough drum at the one face thereof.

4. The arrangement in accordance with claim 1, wherein the trough drum has two faces, and wherein the actuating drive means with correspondingly actuated alignment contacts are arranged at both faces of the trough drum.

5. The arrangement in accordance with claim 4, wherein the actuating drive means at each face of the trough drum comprises a wobble disk which rotates with the trough drum at the respective face thereof.

6. The arrangement in accordance with claim 1, wherein the receiving troughs each have a trough bottom and the alignment contacts each include a contact surface for contacting the rod-shaped object, and in an area of the contact surface each alignment contact includes a recess thereby defining a roofed area over the trough bottom, and the receiving trough includes suction conduits which terminate in the roofed area and which operate together with the alignment contacts for aligning the rod-shaped objects.

7. The arrangement in accordance with claim 6, further including a circumferential cover covering the trough drum in an alignment zone in which the suction conduits are activated for displacing the rod-shaped objects in the receiving troughs against the alignment contacts.

* * * * *